US006547472B2

(12) United States Patent
Jordan

(10) Patent No.: US 6,547,472 B2
(45) Date of Patent: Apr. 15, 2003

(54) ALBUM PAGE

(75) Inventor: John P. Jordan, Rehoboth, MA (US)

(73) Assignee: Intercraft Company, Statesville, NC (US)

( * ) Notice: Subject to any disclaimer, the term of this patent is extended or adjusted under 35 U.S.C. 154(b) by 15 days.

(21) Appl. No.: 09/764,932

(22) Filed: Jan. 18, 2001

(65) Prior Publication Data

US 2002/0093187 A1 Jul. 18, 2002

(51) Int. Cl.[7] ..... B42F 13/00
(52) U.S. Cl. ..... 402/79; 281/38
(58) Field of Search ..... 281/38, 45; 402/79; 40/124.01, 124.06, 709

(56) References Cited

U.S. PATENT DOCUMENTS

| | | | | | |
|---|---|---|---|---|---|
| 1,676,492 | A | | 7/1928 | Goodwin | 40/124.4 |
| 1,769,610 | A | | 7/1930 | Vogel | 40/124.4 |
| 2,421,503 | A | | 6/1947 | Hermon | |
| 3,587,187 | A | | 6/1971 | Sibley | 40/776 |
| 3,596,393 | A | | 8/1971 | Lithgow | |
| 3,651,591 | A | | 3/1972 | Woodyard | |
| 4,244,762 | A | | 1/1981 | Holson | |
| 4,356,649 | A | | 11/1982 | Diamond et al. | |
| 4,405,228 | A | | 9/1983 | Muscoplat | |
| 4,447,973 | A | | 5/1984 | Wihlke | |
| 4,702,026 | A | | 10/1987 | Shaine | 40/776 |
| 4,810,544 | A | * | 3/1989 | Hickman | 402/79 |
| 4,965,948 | A | | 10/1990 | Ruebens | |
| 5,301,445 | A | | 4/1994 | Hoffmeister | |
| 5,458,938 | A | | 10/1995 | Nygard et al. | 428/137 X |
| 6,012,866 | A | * | 1/2000 | Podosek | 402/79 |
| 6,019,539 | A | * | 2/2000 | Lynton | 402/79 |
| 6,135,663 | A | * | 10/2000 | Tan | 402/79 |
| 6,171,008 | B1 | * | 1/2001 | Ochsner | 402/79 |

FOREIGN PATENT DOCUMENTS

| | | |
|---|---|---|
| DE | 534428 | 6/1930 |
| DE | 94 04 489.9 | 8/1994 |
| EP | 0 619 193 A1 | 1/1996 |
| FR | 332929 | 6/1903 |
| GB | 11790 | 6/1894 |
| GB | 29275 | 12/1897 |
| WO | WO 95 35218 | 12/1995 |

* cited by examiner

*Primary Examiner*—Willmon Fridie, Jr.
(74) *Attorney, Agent, or Firm*—Schiff Hardin & Waite

(57) ABSTRACT

An album page for displaying articles, such as photographs, includes at least two sheets, and preferably an opaque sheet located between two transparent outer sheets. The sheets are sealed together, preferably by heat welding or ultrasonic welding to create an album attachment section and a display section. The display section has a pair of stair-step shaped seal arrangements which, together with a sheet seal, are adapted to define horizontal display surfaces having a variety of widths, thereby permitting a variety of different sizes of planar objects to be displayed. The seal arrangement is also preferably made by ultrasonic welding. In all of the display positions, the objects are supported on both of their bottom corners.

18 Claims, 4 Drawing Sheets

ALBUM PAGE

CROSS-REFERENCES TO RELATED APPLICATIONS, IF ANY

None.

BACKGROUND OF THE INVENTION

1. Field of the Invention

The present invention relates generally to album pages useful for the display of planar objects, and more particular, in the illustrated embodiments, to the display of photographs. In its most preferred embodiment, the present invention relates to an album page which may be used to display similar or variously sized photographs in either a vertical or a horizontal position, and when displayed horizontally, the page supports the photograph on both sides of its bottom edge to prevent skewing of the photograph.

2. Description of the Prior Art

A wide variety of pages or sheets used to support and display planar objects are known in the art. Such objects may be stamps, letters, art works, photographs, recipes or any of a wide variety of other objects. The size of the objects can also vary widely, so that the number of objects to be displayed per page or sheet can range from a single object to a large number of objects. Moreover, certain prior art album pages or display sheets have been designed for the display of different size objects on the same sheet and for various orientations thereof, and in some cases the display of a plurality of similarly sized objects in different orientations. Several examples of prior art pages and sheets will be described to provide the reader with additional background.

A stamp display page is illustrated in U.S. Pat. No. 4,356,649 issued Nov. 2, 1982, to Diamond, et al. for "Page Construction for a Stamp Album." It shows on its cover sheet a prior art page displaying three smaller stamps and one larger stamp and an alternative page showing spaces for four stamps. Cut-outs and plastic strips are used in the page construction.

Another album page product is shown in U.S. Pat. No. 2,421,503 issued Jun. 3, 1947 to Hermon for "Visible Card, Photograph, and Other Filing Sheets." Here a central opaque sheet is bounded on both sides by transparent sheets, which are cemented along the edges and in parallel, horizontal lines. Slits are provided to form pockets and channels are impressed into the sheets. The transparent material, slits and channels create pockets for receiving photographs and the slits on one side of the opaque sheet are aligned with the channels on the opposite side.

A display page for photographs, which includes space for memorandum descriptions, is shown in Beese French Patent No. 332,929 issued in 1903. Openings and slots are provided for display of pictures on either side of the sheet, and where two or more photographs are potentially able to contact one another in an album, an intermediate flyleaf is included. This patent, and a non-official translation thereof, are provided with the present application.

Another patent showing a page having room for the display of one or more photographs and accompanying data is shown in British Patent Specification No. 11,790 issued in 1894, a portion of which specification is supplied with this application. Such portion was obtained from the U.S. Patent Office prosecution history of the Ruebens patent discussed later herein.

A British Provisional Specification No. 29,275 dated in 1897, obtained from the same source described in the preceding paragraph, shows the use of a plurality of transparent strips, partially attached to an album page or sheet, to cover the objects to be displayed and to protect them.

A German Patent 534,428 issued in 1930, again obtained from the same source as the preceding foreign patents, shows a page having a first area for the display of a photograph and a second area in which descriptive matter may be provided.

Additional disclosures can be found in more recent U.S. patents. For example, U.S. Pat. No. 3,596,393 issued Aug. 3, 1971 to Lithgow, et al. and entitled "Device for the Housing and Storage of Microfilm" contains a rather specific disclosure of the use of two clear sheets, spot welded (or adhered) at spaced apart locations about the perimeter of the two superimposed sheets and at spaced apart internal locations, so that all of the welded spots are located in both a horizontal row and a vertical row. In use of the device, the microfilm strips can be inserted horizontally or vertically for display. One sheet may be larger than the other to provide an area for attaching the display to a file, or one sheet may be double the size of the other to fold thereover, creating a file.

U.S. Pat. No. 3,651,591 issued Mar. 28, 1972 to Woodyard for "Photo Album Page" describes a page which is opaque and which includes a series of clear strips adhered thereto along their bottom edges, their inner edges and at a plurality of locations along their top edges. Photographs may be inserted into the open ends of the resulting sleeves or between spaces in the top edges of the strips.

Yet a further prior art example is the "Card Negative Holder and Method of Manufacture" shown in U.S. Pat. No. 4,405,228 issued Sep. 30, 1983 to Muscoplat. In this device, which can be a book page, pressure-sensitive stock is used to hold negatives on a flat member, slits being provided for the insertion of negatives or the like. The flat member has a window through with the negative may be viewed.

U.S. Pat. No. 4,244,762, issued Jan. 13, 1981 to Holson and entitled "Heat Sealed Photo Album Page and Method of Making Same," and assigned to the assignee of the present invention, uses a fibrous, centrally disposed sheet and a pair of overlying clear synthetic resinous sheets. Pockets are formed by ultrasonic sealing of the clear sheets together through the fibrous sheet which disintegrates under the generated heat of sealing. Pockets are formed during a continuous sealing operation at the same time the page is laminated. The pockets are formed by sealing in broken lines, whereby the fibrous sheet retains structural integrity in some areas.

Another patent owned by the assignee of the present invention was issued on Apr. 12, 1994 to Hoffmeister. This U.S. Pat. No. 5,301,445 entitled "Album Page for Bi-Directional Insertion and Centering of Rectangular Images" includes a backing sheet and at least one pocket comprising a transparent sheet. The pocket is defined by attaching the backing sheet and the transparent sheet along the bottom and two opposed side edges and including two bracket seals, which extend upwardly from the bottom edge to retain an image in a fixed and centered position. The brackets are selected in height to permit either the vertical or horizontal display of similarly sized photographs which, in either case, are inserted from the top.

Two further prior art systems include the Wihike U.S. Pat. No. 4,447,973 issued May 15, 1984 for "Album Leaf with Pockets for Insertion of Photographic Paper Prints and Similar Articles" and Ruebens U.S. Pat. No. 4,965,948 issued Oct. 30, 1990 for "Bi-Directional Album with Memo Area." In the former, a transparent sheet is welded to an opaque sheet along the edges and at various other horizontal and vertical locations to form pockets adapted to receive photographs. In one or more of the pockets, a single weld line extends from an edge by an amount which limits the orientation of a photograph to either a standing vertical orientation or a horizontally oriented position.

The Ruebens patent takes a somewhat different approach in providing a rectangular, opaque sheet which is bounded on both sides with transparent sheets narrower than the opaque sheet. The transparent sheets are each glued around the top, bottom and one side edge, corresponding to the outer vertical edge of the opaque sheet. This leaves the inner edge of each transparent sheet open along its entire length for the insertion of photographs. The patent also discloses the use of at least two, spaced-apart attachment lines extending from the outer, glued edge toward the inner non-attached edge, the distance being selected to permit horizontal insertion of pictures (i.e., between an upper or lower glue edge and one of the attachment lines or between a pair of the attachment lines) or the vertical insertion of one or more pictures (depending on the height of the page and the picture size) in such a manner that they lie entirely between the innermost ends of the attachment lines and the unattached edge of the transparent sheet.

Several drawbacks still exist with these various prior art album pages, some having to do with manufacturing, and some having to do with the finished article itself. One improvement over a number of such prior art systems has been practiced by the assignee of the present invention, namely the use of film-to-film sealing rather than the use of glue to adhere transparent sheets to the substrates. This has been accomplished by cutting out (for example using a die cutter) certain portions of the substrate and heat or sonic welding two transparent layers to one another at the location of the cut-outs. Not only is there a savings in adhesive costs, the resulting film-to-film bond is stronger than the bond typically created between a film layer and a substrate using a liquid adhesive. The present assignees' prior device also permitted the use of a creased, cylindrical sleeve of clear plastic provided over the opaque sheet, eliminating high speed manufacturing problems with sheet alignment. Further, in a recent version of such sheet, horizontal, elongate cut-outs have been provided to permit the insertion of photographs along the left edge of a page in either horizontal or vertical alignments. Moreover, a small, cut-out at the center of the sheet provides additional stability when two photographs are inserted for display in a vertical orientation.

In a still more recent version of the assignee's album sheets, cut-outs at the corners, one side and along the bottom of the page, along with horizontally spaced seals between the top and bottom have been used to achieve enhanced page versatility. See also PCT Publication WO95/35218 published Dec. 29, 1995.

The elimination of the drawbacks of the prior art in an inexpensive, easy-to-assemble and aesthetically pleasing album page would represent a significant advance in this crowded and competitive field.

SUMMARY AND FEATURES OF THE INVENTION

A primary feature of the present invention is to provide an inexpensive, easy-to-manufacture and aesthetically pleasing album page which overcomes the above-noted disadvantages of prior album systems.

Another feature of the present invention is to provide an album page wherein all attachments of component parts are made using the same type of manufacturing operation, which preferably is heat or ultrasonic welding.

A different feature of the present invention is to provide an album page in which all components are securely attached together and which avoids the use of liquid adhesives.

A different feature of the present invention is to provide the capability, on a single page, of displaying a wide variety of photographs of different sizes in a variety of orientations, and when displaying objects horizontally on the sheet to adequately support both bottom corners of the object to maintain an aesthetically pleasing appearance and prevent skewing of the photograph or other displayed object. Also, when displaying photograph vertically, bottom support is provided for each such photograph.

How these and other features of the present invention are accomplished, individually or in various subcombinations, is described in the following detailed description of the preferred embodiment of the invention, taken in conjunction with the drawings. Generally, however, they are accomplished in an album page including an opaque center sheet and holes for inserting the page in an album. Transparent material, preferably made from a thermoplastic resin is placed over both sides of the page, preferably by wrapping a single clear sheet around over one side and folding it so that the sheet ends lie along an opposed side. The assembly is then heat or ultrasonically welded at various locations, including at least one weld extending from the top to the bottom of the page and a pair of stair step, spaced-apart seal arrangements along the bottom. The stair step seals allow a plurality of different sizes of rectangular objects to be displayed horizontally and at least one rectangular object to be displayed vertically. Other ways in which the objects of the present invention are accomplished will be described in the following specification or will become apparent to those skilled in the art after they have read this specification. Such other ways are deemed to fall within the scope of the present invention if they fall within the scope of the claims which follow.

BRIEF DESCRIPTION OF THE DRAWINGS

In the FIGURES, like reference numbers are used for like components and

DETAILED DESCRIPTION OF THE PREFERRED AND ALTERNATE EMBODIMENTS OF THE PRESENT INVENTION

Before proceeding to a detailed description of the invention and a description of the FIGURES, several general comments can be made about the applicability and the scope of the present invention.

First, while photographs are used to illustrate the type of objects which can be displayed using the album page of the present invention, a variety of other planar objects could be substituted, such as paper sheets, cards, announcements, artwork, memo slips, and the like.

Second, it is preferable that an opaque sheet be sandwiched between two transparent sheets so that the reverse sides of the album pages may be used to display photographs. The center sheets may be clear or colored. It is preferable that all sheets be thermoplastic so that ultrasonic welding or other forms of heat welding can be employed to provide the various seals and display arrangements which will be illustrated in the FIGURES. Ultrasonic welding is the preferred technique to form film-to-film seals at various locations on the page.

Third, dies may be used for cutting holes in the page and the number thereof can vary depending on the overall size of the page and the size of the album with which it will be used.

Fourth, certain dimensions are given in connection with the description of the drawings that illustrate various capabilities of the page of the present invention. However, these dimensions are exemplary only and the size of the pages themselves and the number and location of the seals can be variously embodied. For example, a larger page can be constructed than that shown in FIGS. 5–12, in which case portrait-sized photographs or larger planar objects of other types may be displayed.

Fifth, while the invention is primarily directed and is entitled "Album Page", the pages of the present invention need not contain any specific structure for inserting the pages in a book (such as holes or spiral binding openings), and the pages may be configured to have openings into the space between the outer transparent films and the center sheet from a side as well as from the top. These arrangements are suitable, for example, if the pages are to be used for evidence photographs (for example) or other planar information where the entire page might be inserted as a self-contained holder in a larger file.

Sixth, while a stair step arrangement is illustrated in the FIGURES, each step having a height which is the same as the depth of each stair, those dimensions could likewise be altered. For example, a line extending between the sides and the bottom of the album page could be notched at the stair locations (such as those illustrated) and still perform the same functions as the uniform stairs without departing from the invention's intended scope.

Figure 1:
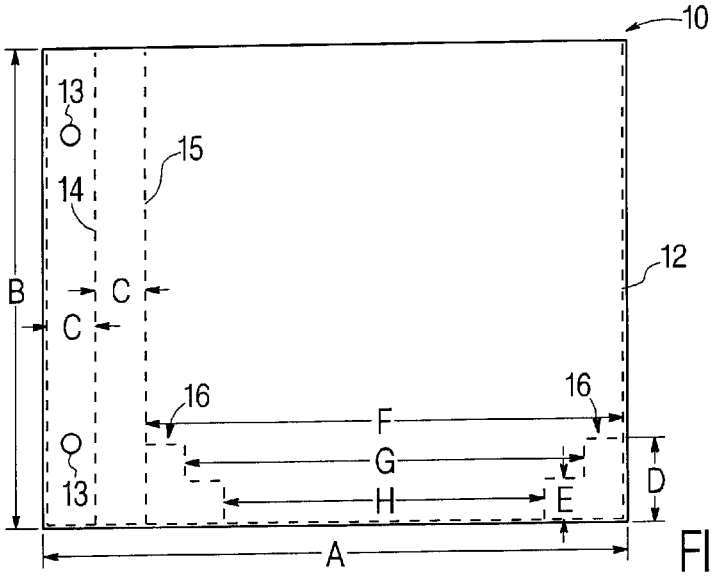
FIG. 1 is a front view of an album page according to a preferred embodiment of the present invention.

FIG. 1 is a front view of a preferred album page 10 of the present invention. As indicated above, ultrasonic welding is the preferred technique for joining the sheets as will become apparent upon further examination of FIG. 1 and the remaining FIGURES. From the front view of FIG. 1, it will first be appreciated that the three sheets are ultrasonically sealed at 12 about the right side, the bottom and the left side. In addition, vertical seal lines 14 and 15 extend from the top to the bottom of page 10 nearer the left side, lines 14 and 15 being spaced apart equally.

In the illustrated embodiment, the width A is 18.8 cm, and the height B is 15.4 cm. The distances represented by letter C are each 1.6 cm. Holes 13 are provided between the left side seal 12 and seal 14 for allowing the page to be inserted into an album.

A simple, two-step seal arrangement 16 is shown at each of the lower corners of the area defined by seal line 15 and the right side seal line 12. The stair arrangement has a total height D of 2.6 cm, and each step has a height of 1.3 cm. The result is the creation of three horizontal display locations having dimensions identified by letters F, G and H. Proceeding from the top toward the bottom, the three support areas have decreasing widths of 15.6, 13.0 and 10.4 cm, respectively.

Figure 2:
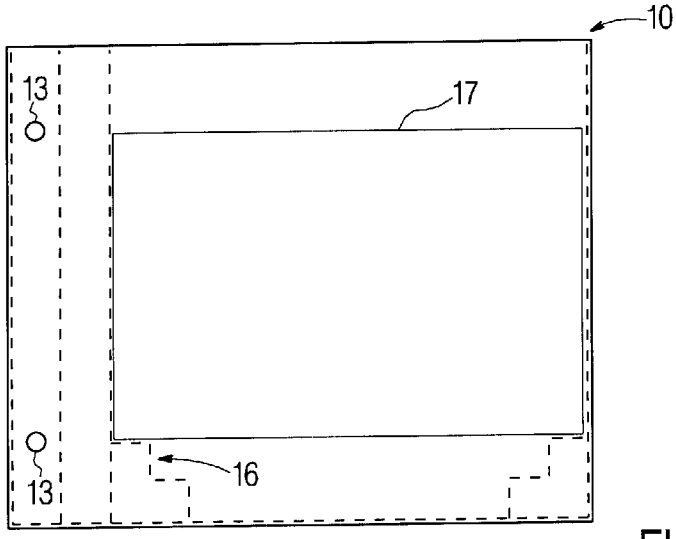
FIG. 2 is a front view of the album sheet shown in FIG. 1 with a 6×4 photograph.
Figure 3:
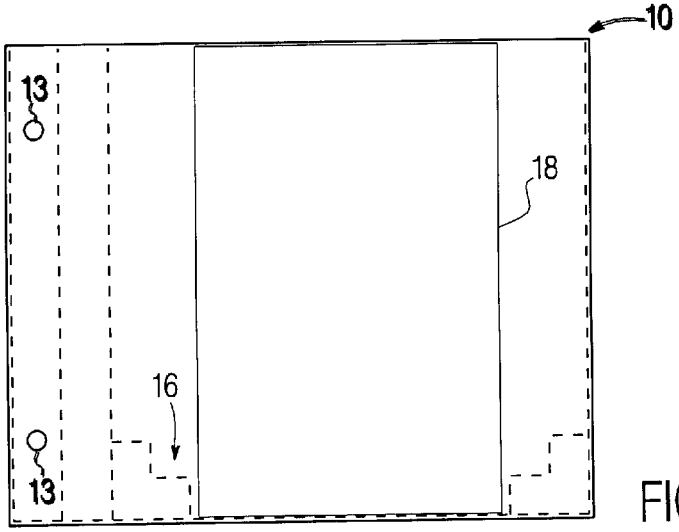
FIG. 3 is a front view of the album page shown in FIG. 1, with a 4×6 photograph displayed vertically.
Figure 4:
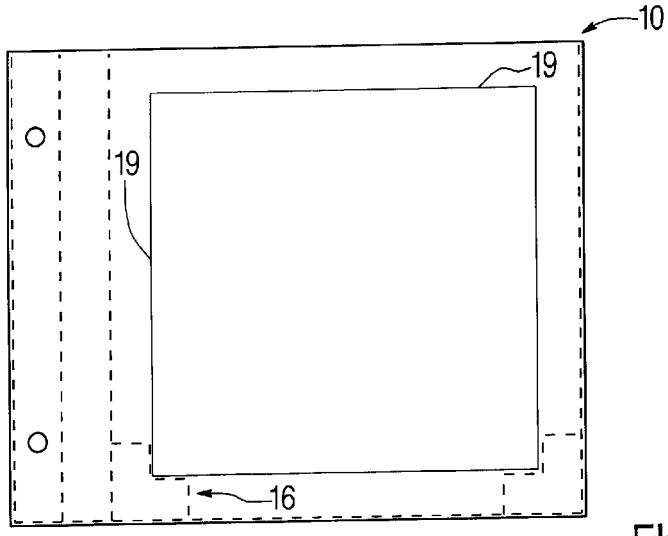
FIG. 4 is a front view of the album page shown in FIG. 1 with a 5×5 photograph.

Proceeding next to the FIGS. 2–4, some of the variety of different objects which may be displayed in album page 10 are illustrated. For example, in FIG. 2, a 6×4 inch photograph 17 can be displayed with its lower corners resting on top of the seal arrangement 16. FIG. 3 shows a 4×6 inch photograph 18 displayed vertically with its narrow edge adjoining the bottom of page 10 and its sides located intermediate the risers of the first step of seal arrangements 16. FIG. 4 shows the use of page 10 for the display of a 5×5 inch photograph 19, with the photograph residing on the middle steps for horizontal support.

Figure 5:
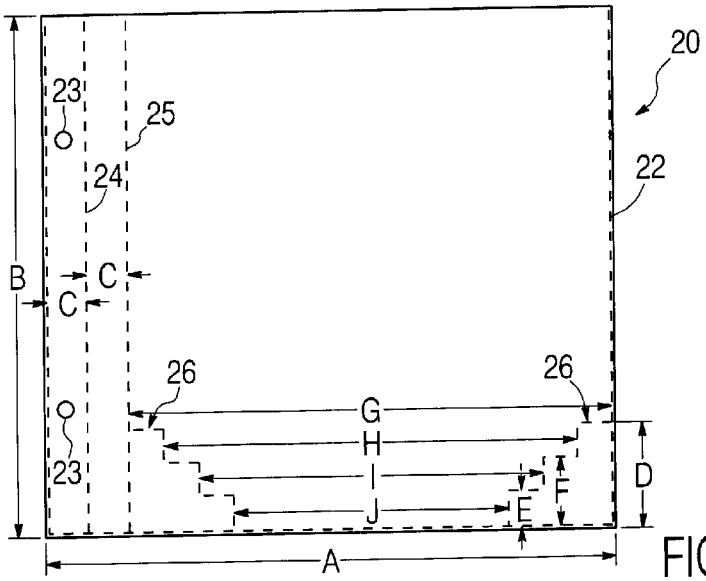
FIG. 5 is a front view of an alternate embodiment of the present invention employing three stair seal arrangements.

As previously mentioned, the number of steps, their dimensions and the like, can be selected depending upon the types of objects to be displayed. In this connection, a larger page 20 is shown in FIG. 5 which includes two three-step seal arrangements 26 at the lower corners of its display area. Album page 20 includes seal or ultrasonic 22 about its right, bottom and left sides, the intermediate seal lines 24 and 25 and holes 23 for holding the page within an album. The preferred size for page 20 is 21.4 cm wide and 19.2 cm high as illustrated by reference letters A and B, respectively. As with page 10, the distance C is 1.6 cm. Also, consistent with the other page, each step has a height of 1.3 cm giving a first step height E of 1.6 cm, a second step height F of 2.6 cm and a top step height D of 3.9 cm.

In this version of the page of the present invention, there are four separate horizontal supports locations G–J. G is 18.2 cm wide. H is 15.6 cm wide. I is 13.0 cm wide, and J is 10.4 cm wide. The variety of different sized objects which may be displayed in page 20 will again be illustrated with photographs in connection with FIGS. 6–12.

Figure 6:
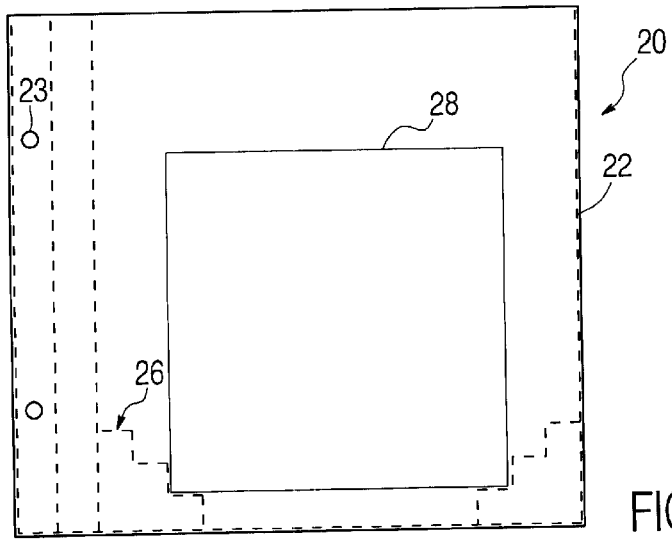
FIG. 6 is a front view of the album page shown in FIG. 5, with a 5×5 photograph.
Figure 7:
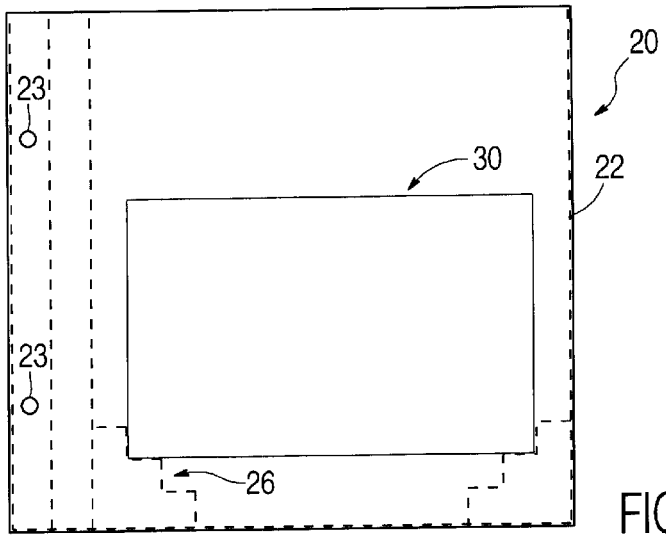
FIG. 7 is a front view of the album page shown in FIG. 5, with a 6×4 photograph.
Figure 8:
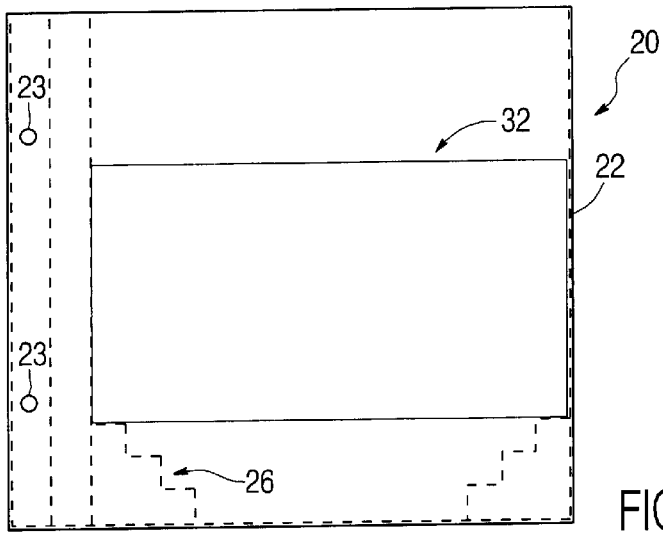
FIG. 8 is a front view of the album page shown in FIG. 5, with a 7×4 photograph displayed horizontally.
Figure 9:
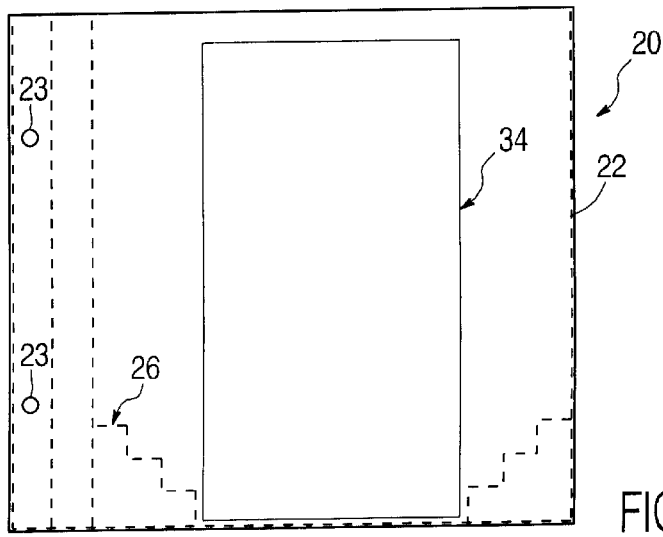
FIG. 9 is a front view of the album page shown in FIG. 5, with a 4×7 photograph displayed vertically.
Figure 10:
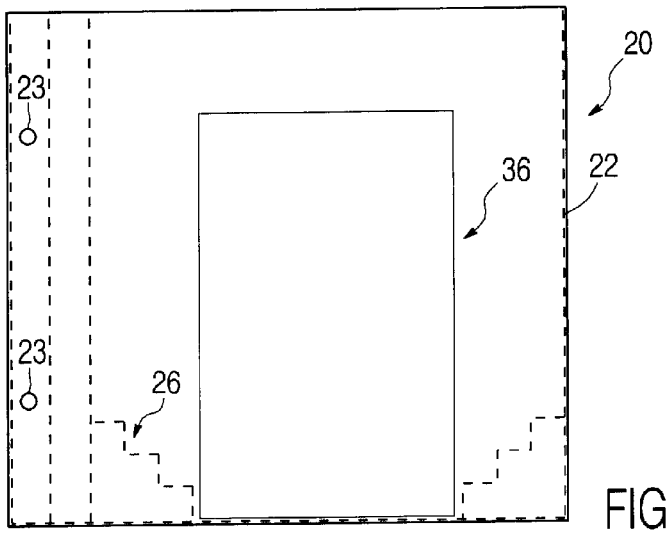
FIG. 10 is a front view of the album page shown in FIG. 5, with a 4×6 photograph displayed vertically.
Figure 11:
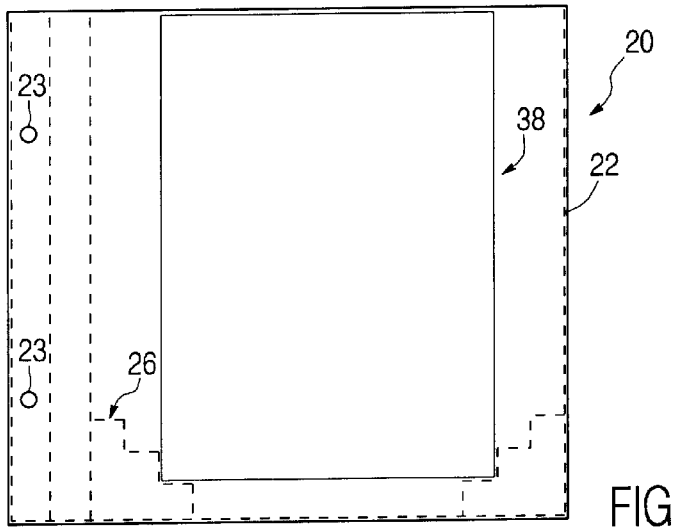
FIG. 11 is a front view of the album page shown in FIG. 5, with a 5×7 photograph shown displayed vertically.
Figure 12:
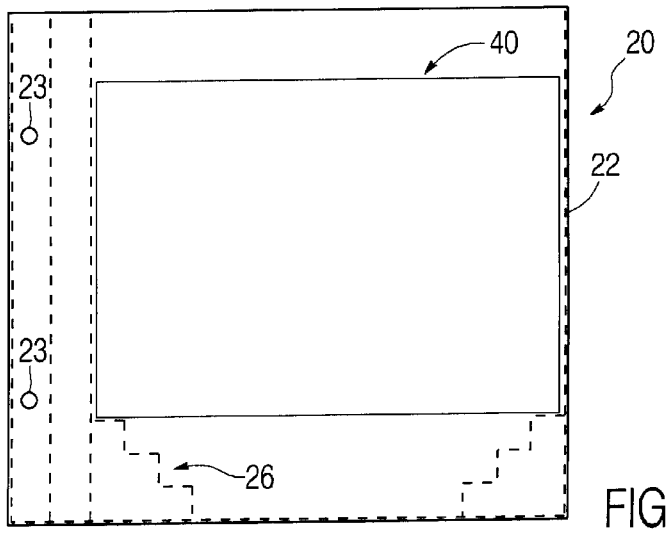
FIG. 12 is a front view of the album page of FIG. 5, with a 7×5 photograph displayed horizontally.

FIG. 6 shows a 5×5-inch photograph 28 displayed with its bottom corners resting on the first steps. FIG. 7 shows a 6×4-inch photograph 30 displayed horizontally with its bottom corners residing on the second steps. FIG. 8 shows a 7×4-inch photograph 32 with its bottom corners residing on the third steps. FIG. 9 shows a 4×7-inch photograph 34 displayed vertically with one of its shorter edges residing on the bottom seal. FIG. 10 shows a 4×6-inch photograph 36 with one of its shorter sides resting on the bottom seal. FIG. 11 shows a 5×7-inch photograph 38 displayed vertically with its bottom corners residing on the first steps, and FIG. 12 shows a 7×5-inch photograph 40 displayed horizontally with its bottom corners resting on the third steps.

As can be seen from a comparison of the two illustrated examples, the variety of objects which may be displayed increases dramatically for each additional step. It should also be kept in mind that the photograph or other planar object disposed on the rear pocket of the album page can be the same or different from that displayed on the front. So while the present invention has been described and illustrated in connection with two preferred album pages 10 and 20, the scope of the invention is not limited by the illustrations or their descriptions but is to be limited solely by the scope of the claims which follow.

What is claimed is:

1. A page for displaying at least one planar object having a pocket formed from two sheets, at least one sheet being transparent, the page comprising:

a horizontal seal between the two sheets; and a pair of spaced apart seal arrangements extending upwardly and outwardly from the horizontal seal, each seal arrangement comprising at least one substantially horizontal surface as a step, whereby a planar object may be displayed between the seal arrangements and a second, larger planar object may be displayed on the pair of horizontal step surfaces.

2. The page of claim 1, wherein each seal arrangement is a stair arrangement having vertical risers and horizontal steps.

3. The page of claim 1, wherein the seal arrangement has at least two steps.

4. The page of claim 2, wherein each seal arrangement has three steps.

5. The page of claim 1, wherein the page is comprised of two transparent sheets and a center opaque sheet.

6. The page of claim 1, wherein at least the transparent sheet is a thermoplastic sheet.

7. The page of claim 1, wherein the sheet is rectangular and is sealed about a pair of opposed sides and one additional side.

8. The page of claim 7, wherein a pair of spaced apart seal lines extend from its open side to the one additional side.

9. The page of claim 1, wherein the sheets are thermoplastic and the horizontal seal and the seal arrangements are made by ultrasonic welding.

10. The page of claim 1, wherein the sheets are thermoplastic and the horizontal seal and the seal arrangements are made by heat welds.

11. An album page for displaying planar objects having a side to be displayed horizontally comprising:

first and second transparent outer thermoplastic sheets;

an inner thermoplastic sheet, the three sheets forming a three-layer rectangular article;

a seal extending about three adjoining sides of the article;

a pair of spaced apart seal arrangements extending upwardly and outwardly from the middle one of the three sealed sides, each seal arrangement comprising a stair-step arrangement including risers perpendicular to the middle one of the sealed sides and stairs parallel thereto, the risers being spaced further apart from a corresponding riser of the other seal arrangement the greater the distance the risers are from the middle one of the three sealed sides;

whereby a planar object may be displayed between the seal arrangements with the side to be displayed horizontally lying against the middle one of the sealed sides and a larger planar object may be displayed by placing its side to be displayed horizontally on a pair of steps.

12. The page of claim 11, wherein each seal arrangement has at least two steps.

13. The page of claim 12, wherein each seal arrangement has three steps.

14. The page of claim 11, wherein at least the transparent sheets are thermoplastic.

15. The page of claim 14, wherein the sheets are thermoplastic and the horizontal seal and the seal arrangements are made by ultrasonic welding.

16. The page of claim 14, wherein the sheets are thermoplastic and the horizontal seal and the seal arrangements are made by heat welds.

17. The page of claim 11 including a pair of spaced apart seal lines are located near a first of the sealed sides other than the middle one of the three sealed sides, and at least two holes are located intermediate the first sealed side and the nearest of the spaced apart sealed lines.

18. The page of claim 11, wherein articles to be displayed are rectangular photographs having a pair of longer and a pair of shorter sides and the seal arrangements are arranged so that a rectangular photograph can be displayed vertically by having one of its shorter sides abut the seal of the middle one of the sealed sides and the same size photograph can be displayed horizontally by having one of its longer sides be supported by a pair of steps of the spaced apart seal arrangements.

* * * * *